US012674101B2

(12) United States Patent
Stanley et al.

(10) Patent No.: US 12,674,101 B2
(45) Date of Patent: Jul. 7, 2026

(54) MULTI ROW RADIANT COIL ARRANGEMENT OF A CRACKING HEATER FOR OLEFIN PRODUCTION

(71) Applicant: LUMMUS TECHNOLOGY LLC, Houston, TX (US)

(72) Inventors: Stephen J. Stanley, Matawan, NJ (US); Kandasamy M. Sundaram, Old Bridge, NJ (US); Baozhong Zhao, Livingston, NJ (US)

(73) Assignee: Lummus Technology LLC, Houston, TX (US)

( * ) Notice: Subject to any disclaimer, the term of this patent is extended or adjusted under 35 U.S.C. 154(b) by 0 days.

(21) Appl. No.: 17/455,144

(22) Filed: Nov. 16, 2021

(65) Prior Publication Data

US 2022/0154084 A1 May 19, 2022

Related U.S. Application Data

(60) Provisional application No. 63/114,869, filed on Nov. 17, 2020.

(51) Int. Cl.

| | |
|---|---|
| ***F28D 7/00*** | (2006.01) |
| ***C10G 9/20*** | (2006.01) |
| ***F28D 7/06*** | (2006.01) |
| ***F28D 7/08*** | (2006.01) |

(52) U.S. Cl.
CPC ..... *C10G 9/20* (2013.01); *C10G 2300/1044* (2013.01); *C10G 2400/20* (2013.01)

(58) Field of Classification Search
CPC ..... F28D 7/00; F28D 7/06; F28D 7/08
See application file for complete search history.

(56) References Cited

U.S. PATENT DOCUMENTS

| | | | | |
|---|---|---|---|---|
| 6,528,027 | B1 * | 3/2003 | Brewer et al. | C10G 9/20 422/204 |
| 7,964,091 | B2 | 6/2011 | Barendregt et al. | |
| 2002/0034463 | A1 * | 3/2002 | Di Nicolantonio et al. | C10G 9/20 422/198 |
| 2003/0021368 | A1 | 1/2003 | Yoshizaki | |

(Continued)

FOREIGN PATENT DOCUMENTS

| | | |
|---|---|---|
| EP | 2949728 B1 | 8/2019 |
| TW | 387933 B | 4/2000 |

OTHER PUBLICATIONS

International Search Report Issued in Applicaiton No. PCT/US2021/059542, Mailed Mar. 8, 2022, 4 pages.

(Continued)

*Primary Examiner* — Randy Boyer
(74) *Attorney, Agent, or Firm* — Osha Bergman Watanabe & Burton LLP

(57) ABSTRACT

A system for cracking hydrocarbons including a fired heater having a radiant section and a convective section. The radiant coil is disposed within the radiant section of the heater, the radiant coil having three to seven rows of tubes, wherein each row comprises two multi-pass tubes, and wherein the multi-pass tubes of the three to seven rows of tubes are collectively disposed symmetrically or pseudo symmetrically within the radiant section of the heater. The system further including a transfer line exchanger fluidly connected to an outlet tube of each of the three to seven rows of tubes.

15 Claims, 10 Drawing Sheets

(56) References Cited

U.S. PATENT DOCUMENTS

| | | | | |
|---|---|---|---|---|
| 2003/0213687 | A1* | 11/2003 | Platvoet | C10G 9/20 202/96 |
| 2016/0045889 | A1 | 2/2016 | He et al. | |
| 2017/0137722 | A1 | 5/2017 | Petela et al. | |
| 2018/0051906 | A1* | 2/2018 | Yuan et al. | C10G 9/20 |
| 2020/0081424 | A1 | 3/2020 | Bianchi et al. | |

OTHER PUBLICATIONS

Written Opinion Issued in Applicaiton No. PCT/US2021/059542, Mailed Mar. 8, 2022, 4 pages.
Office Action issued in corresponding TW Application No. 110142770 with English translation dated Jun. 16, 2022 (8 pages).
Office Action issued in Canadain Application No. 3,199,413 mailed on Jul. 14, 2025 (3 Pages).
Office Action issued in United Arab Emirates Application No. P6001148/2023, (5 pages).

* cited by examiner

MULTI ROW RADIANT COIL ARRANGEMENT OF A CRACKING HEATER FOR OLEFIN PRODUCTION

FIELD OF THE DISCLOSURE

Embodiments of the present disclosure generally relate to heaters for use in the cracking of hydrocarbons. More specifically, embodiments herein relate to cracking heater design and arrangement of the radiant coils.

BACKGROUND

Most cracking heaters for ethylene production dispose the radiant coils in an in-line arrangement in a single row. In some cases, two rows are arranged either in offset arrangement or staggered arrangement.

One example of a radiant coil is illustrated in FIG. 14. The feed is distributed through venturis 2 to a number of inlet tubes 10 (8 as shown for the coil of FIG. 14). The feed passes through the radiant zone of the heater, is combined into a manifold 4, and then fed through a larger diameter outlet tube 12 to a transfer line exchanger (TLE) 14. As illustrated, there are two outlet tubes 10 each (left and right sides of the TLE 14) and hence a total of four outlets for this configuration. In FIG. 14, only one side of the TLE 14 is illustrated.

Other various short residence time (SRT) coils are available from Lummus Technology LLC, including SRT-1 (typically an 8 pass serpentine coil: denoted as 1-1-1-1-1-1-1-1) to SRT VII (typically 32 inlet tubes and 4 outlet tubes); SRT II-VI have different designs. Two outlet tubes may be joined by one WYE piece and connected to a TLE or the four outlet tubes are directly connected to the TLE. Currently only a maximum of four outlet tubes are connected to a TLE.

Similarly, U.S. Pat. No. 7,964,091 describes a triple row arrangement for 1-1 and 2-1 coils. Also described is a similar arrangement for a six pass coil.

SUMMARY

One or more embodiments disclosed herein relate a system for cracking hydrocarbons including a fired heater having a radiant section and a convective section. The radiant coil is disposed within the radiant section of the heater, the radiant coil having three to seven rows of tubes, wherein each row comprises two multi-pass tubes, and wherein the multi-pass tubes of the three to seven rows of tubes are collectively disposed symmetrically or pseudo symmetrically within the radiant section of the heater. The system further including a transfer line exchanger fluidly connected to an outlet tube of each of the three to seven rows of tubes.

One or more embodiments disclosed herein related to a system for cracking hydrocarbons including a fired heater having a radiant section and a convective section. The radiant coil is disposed within the radiant section of the heater, the radiant coil having three to seven rows of tubes, wherein each row is collectively disposed symmetrically or pseudo symmetrically within the radiant section of the heater. The system further including a transfer line exchanger fluidly connected to an outlet tube of each of the three to seven rows of tubes.

One or more embodiments disclosed herein relate to a method for cracking hydrocarbons. The method including heating a hydrocarbon feedstock in one or more rows of tubes in a radiant section of a fired heater having the radiant section and a convective section. Each row of tubes includes two multi-pass tubes, wherein the multi-pass tubes of the three to seven rows of tubes are collectively disposed symmetrically or pseudo symmetrically within the radiant section of the heater. The method further including cracking one or more hydrocarbons in the hydrocarbon feedstock in the one or more rows of tubes, recovering a cracked hydrocarbon stream from an outlet tube on each of the one or more rows of tubes, and feeding the cracked hydrocarbons to a transfer line exchanger fluidly connected to the outlet tube of each of the one or more rows of tubes.

Other embodiments disclosed herein will be understood by those having ordinary skill in the art based on the following description.

BRIEF DESCRIPTION OF DRAWINGS

In the Figures, where appropriate, like reference numerals correspond to like parts.

DETAILED DESCRIPTION

Figure 14:
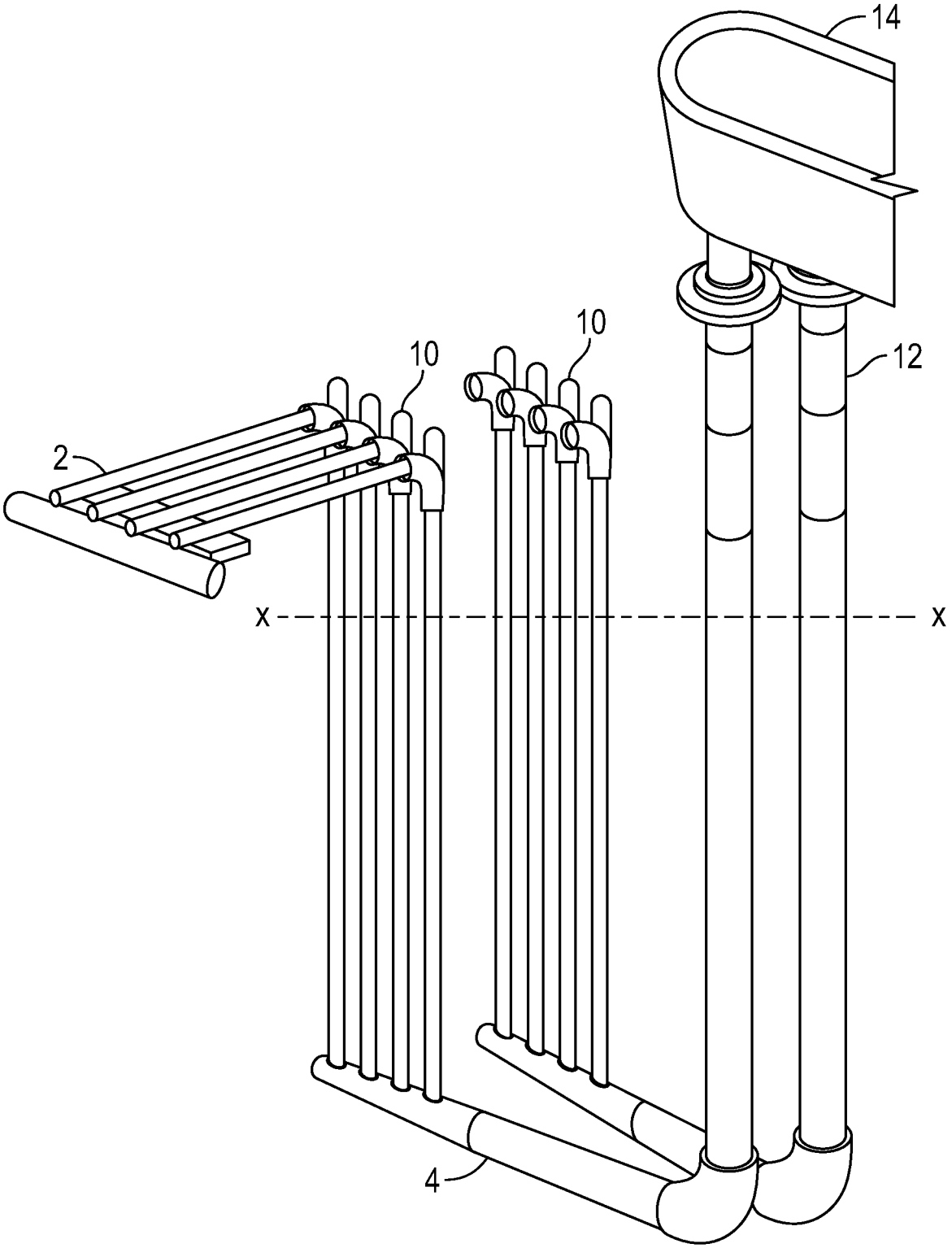
FIG. 14 illustrates a prior art coil configuration.

As used herein, coil configurations may be referred to as having a x-y arrangement, an x-y-z arrangement, a x-y-z-w arrangement, or others, where x refers to the number of inlet tubes and y refers to the number of tubes in the next pass, be it an outlet pass (x-y) or a second pass x-y-z, with z being the outlet pass. For example, referring to FIG. 14, the arrangement is a 4-1, where four inlet tubes 10 feed one outlet tube 12. The coil arrangement of FIG. 14 includes two rows of tubes 10 per side, and thus may be referred to as an 16-4 (8-2 from left as shown and another 8-2 from right not shown); for simplicity, however, reference is generally made to the sub-groups, each being a 4-1. For other multi-pass arrangements, the number of tubes in each pass is defined, where a 1 1 1 1 1 1 1 1 is an eight pass serpentine coil, and a 4-2-1 coil has four inlet tubes connected to two tubes, such as by Y-connectors to a two tube second pass, then to a single outlet tube. As a general definition of 'n' two pass coil with 'm' inlet tubes for each outlet tube, a single coil will have a "m*2n−2n" arrangement for one coil, where n refers to the number of rows (n=1, 2, 3, also referred to herein as rows). For simplicity, FIG. 14 illustrates a cross-section line 'X-X'. FIGS. 1 and 4-12 illustrate coil arrangements in such a cross-section. However, FIG. 14 illustrates a 4-1 coil arrangement while the other Figures illustrate more or fewer inlet and outlet tubes and different arrangements. The prior art coil of FIG. 14 is illustrated for the purposes of better understanding the graphical illustration of the coils according to embodiments disclosed herein.

Cracking heaters are designed to produce a certain quantity of ethylene. Selectivity, i.e., the amount of ethylene per unit weight of feed converted, is important to be economical in the industry. So, multiple coils in a single heater are used, but each coil may be arranged in a near-linear way to avoid bending of coils. By having a plurality of inlet tubes for each outlet tube, the fluid may be heated rapidly and hence the cracking can happen at high temperature in a short residence time (almost all in the outlet tube). This may produce high selectivity. At the same time, the outlet tubes have a low surface to volume ratio. Coke, a byproduct of pyrolysis reactions, is a solid and its yield is a strong function of heat transfer surface and other transport parameters. Hence coke deposition rate may be reduced with a split coil arrangement. Conventional tubes may have relatively small diameter tubes in all passes and hence many radiant coils (more than 8 coils and sometime as many as 36 coils) have to be combined to get an equivalent ethylene capacity of one split coil as described herein.

Accordingly, one or more embodiments herein relate to a cracking heater design. More specifically, embodiments herein relate to arrangement of coils within a cracking heater and with respect to a transfer line exchanger. By arranging coils according to embodiments herein, it may be possible to reduce the heater cost for a given ethylene capacity and may simplify operations, reduce coke formation, or both.

Cracking heaters according to embodiments herein may include radiant coils having a multirow arrangement with more than two rows of coils. Cracking heaters according to embodiments herein may contain a plurality of radiant coils. The coils may be used for cracking hydrocarbons, such as ethane, propane, butane, and heavier hydrocarbons and mixtures, including naphthas or other heavier hydrocarbons. The cracking may result in the formation of lighter hydrocarbon molecules, including olefins such as ethylene, propylene, and butenes, among others. After the cracking reaction in the radiant coils, the reaction effluents are quickly quenched in transfer line exchangers (TLEs), generating steam, for example. In some cases, the effluents can be quenched with water or oil called direct quench. However, direct quench may be inefficient and indirect quench with super high temperature steam production is the most economically attractive way to freeze or stop the reactions.

With many radiant coil designs, the coils cannot be individually connected to a transfer line exchanger (TLE) as this would be prohibitively expensive and require a large amount of space. Therefore, in one or more embodiments herein, many radiant coils are grouped and connected to a single TLE. For multi-pass coils, this requires all outlet tubes to be brought into close proximity.

Bringing the outlet tubes into close proximity, however, creates issues in arranging the multi-pass coils. For certain arrangements, a shadow effect, or a decrease in total heat exchange, convective and radiant, due to relative placement of the coils and of the coils to the burners, can be considerable and radiant coil run length may be reduced significantly.

Embodiments herein provide for the arrangement of radiant coils in multiple rows with a shorter run length while also being able to connect the plurality of outlet tubes to a single TLE. One or more embodiments may thus increase the heater capacity, reduce the number of TLEs, and simplify the convection section design.

Coils according to embodiments herein may have multiple inlet and outlet tubes. The coils may also have multiple passes, such as from two to twelve passes. Embodiments herein may be directed to arrangements having multiple coils of 4-1 to 16-1 arrangement, for example. Embodiments herein may also be extended outside these configurations to include fewer or more coils and fewer or more passes. Embodiments herein may also be useful for two-pass coils, multi-pass coils, a four-pass coil, a six-pass coil, or a serpentine coil (which may be 8 to 14 passes). Regardless of the configuration, embodiments herein may connect many coils to a single TLE. Embodiments herein may thus provide for arrangement and efficient quenching of systems having more than four outlet tubes, such as six, eight, ten, or twelve outlet tubes.

As many coils are connected to a single TLE according to embodiments herein, ethylene capacity per coil may be increased. Convection section passes and the number of convection tubes, which are based on number of radiant coils, are also correspondingly reduced, as well control valves, control loops, number of radiant section burners, may also be reduced. This may allow for large capacity heaters to be used in place of a greater number of smaller capacity heaters. Currently, with limitations in the convection section passes, the ethylene capacity is around 200-300 KTA (thousand tons per year) per heater. With arrangements according to embodiments herein, the capacity can be increased by 50% for the same number of convection passes (i.e., 300-450 KTA are possible per heater).

Figure 10:
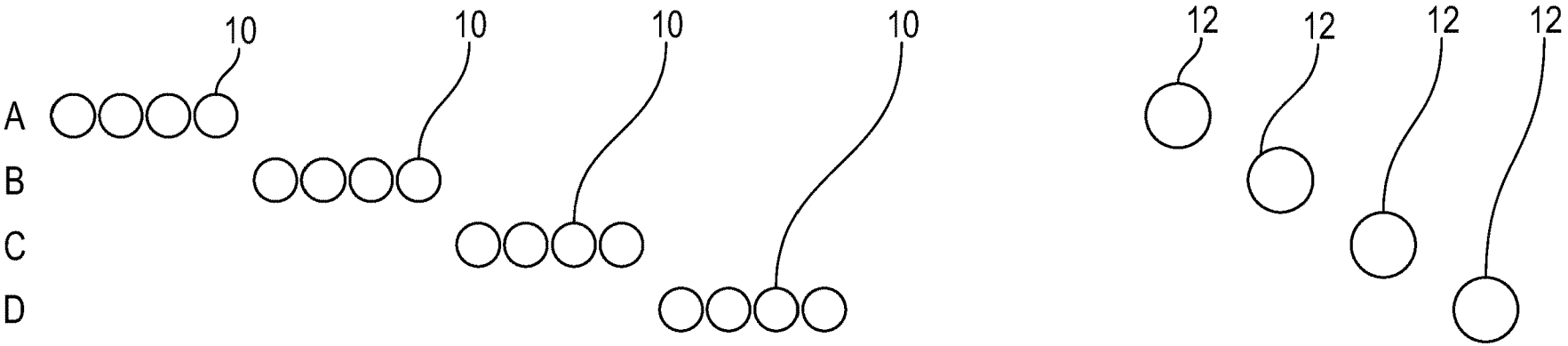
FIG. 10 illustrates a radiant coil arrangement useful in pyrolysis heaters according to one or more embodiments disclosed herein.

Coil and tube arrangements according to embodiments herein may have multiple rows. As many rows as desired may be disposed on both sides of the center of the arrangement and may also be disposed on the center line. This is illustrated, for example, in FIG. 1 with respect to three rows A, B, C for simplicity. However, this can be extended to more than three rows, such as illustrated in FIG. 10 which illustrates four rows A, B, C, D, and FIGS. 11 and 12 which illustrate five rows A, B, C, D, E. Beyond five rows, benefits may not be as high as for three rows. When linear TLEs are used, multiple rows (more than three) may have more benefits. In one or more embodiments disclosed herein, anywhere from three (3) to sixteen (16) rows may be used. For example, 3 rows, 4 rows, 5 rows, 6 rows, 7 rows, 8 rows, 9 rows, 10 rows, 11 rows, 12 rows, 13 rows, 14 rows, 15 rows, or 16 rows may be used.

In one example, a typical three row arrangement with 6-1 type coil may have a two-pass coil with six inlet tubes for each outlet tube. Typically, inlet tube diameters are much smaller than the outlet tube diameter. For example, inlet tubes may be 1.25 inch inner diameter (ID) to 2.5 inch ID for most two pass coils. For multi-pass coils the inner diameter may be larger. For outlet tubes, the diameters may be larger than 3 inches. The tube spacing to outer diameter (OD) ratio may vary from 1.2 to 3.0, such as from 1.4 to 2.0. In an example arrangement, six rows of 6-1 (6 inlet tubes, one outlet tube, six rows of tubes) may be connected to a single TLE. A first 6-1 coil will be kept at south of center line. A second 6-1 will be kept at the center line of the radiant cell. A third 6-1 will be north of the center line. The three outlets may be connected by a trifold fitting to one leg of a wye fitting. A mirror image from the TLE center line will be the other three coils. Therefore, there may be two trifold fittings which are connected to a single inverted Y fitting which connects to a TLE. All these six 6-1 tubes constitutes a single coil. These six coils can be arranged different ways, as illustrated and described further below.

Many possible arrangements for multi-row embodiments are given in the form of illustrations taken along a cross-section similar to the X-X cross-section in FIG. 14. The principle behind each one is similar, referring to a 24-6 coil or six rows of 4-1 type, as an example. In a given radiant cell, there may be more than one 24-6 coil to increase the capacity. Anything described for one coil is applicable for all coils.

Figure 1:
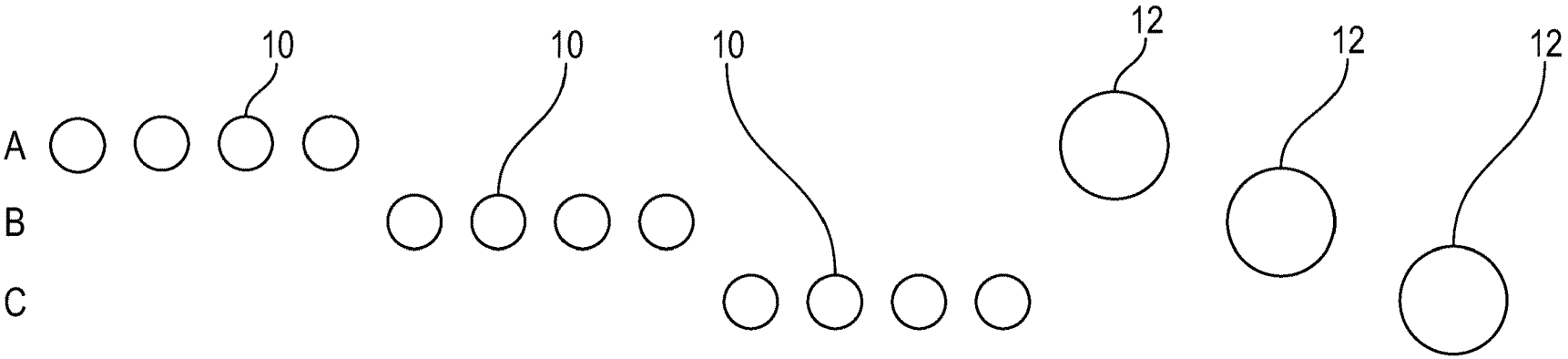
FIGS. 1 and 1A illustrates a radiant coil arrangement useful in pyrolysis heaters according to one or more embodiments disclosed herein.
Figure 1A:
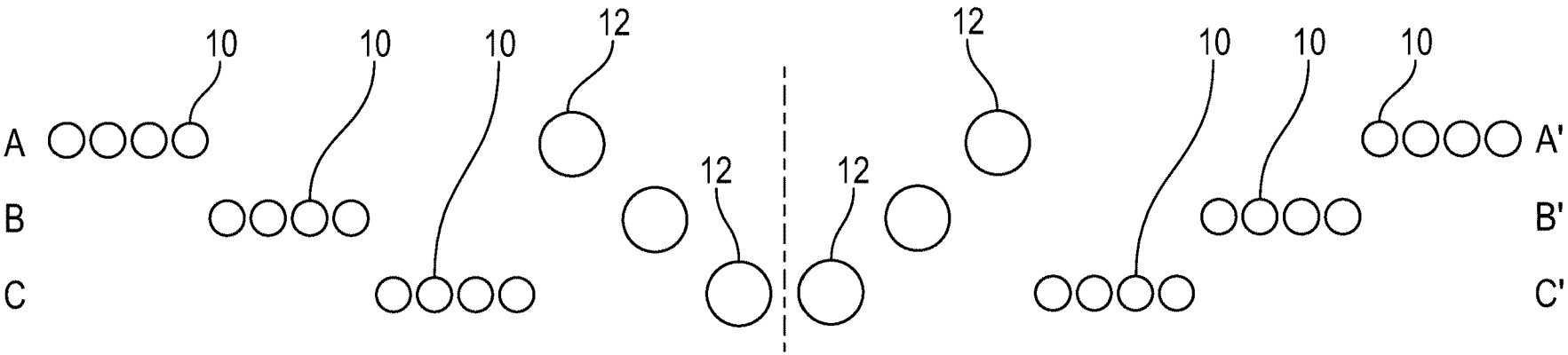

Referring now to FIG. 1, coil A may be on one side of the center row. Coil B may be on the center row. Coil C may be on the second side of the center row. The four inlet tubes 10 of each row feed a respective outlet tube 12 in the same row. The three outlet tubes 12 may then connect to a trifold fitting (not shown). A Y-fitting may be used to connect the outlet of the trifold fittings to the TLE (not illustrated). A mirror image of the coil arrangement in FIG. 1 may be used, where the other side of the TLE connects coils A', B', and C' in a similar manner, such as shown in FIG. 1A.

Figure 3A:
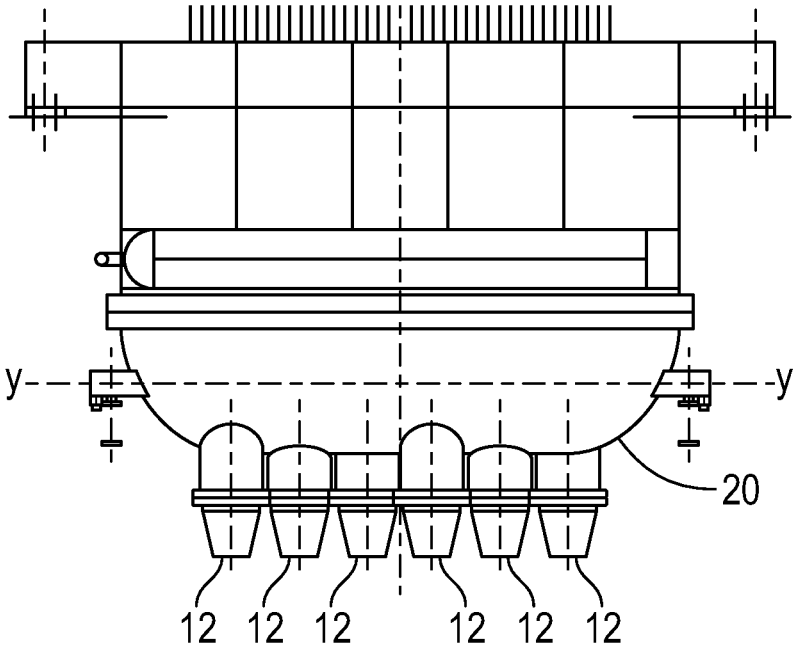
FIGS. 3A and 3B illustrates an arrangement for connecting coils to a transfer line exchanger according to one or more embodiments disclosed herein.
Figure 3B:
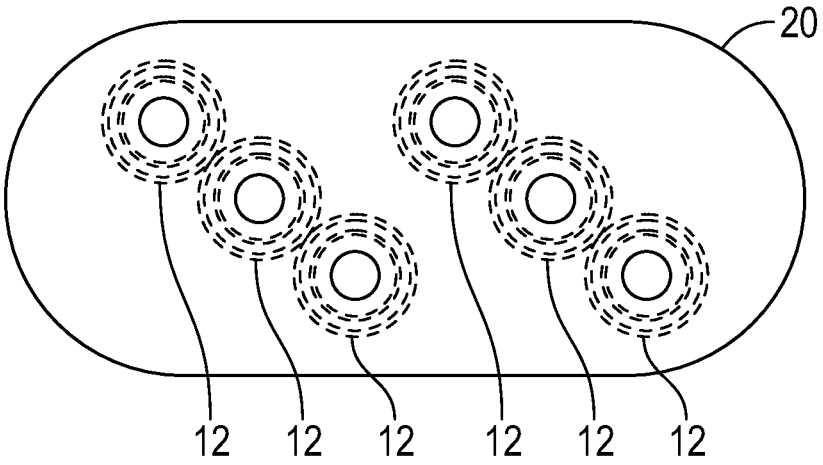

In this manner, six outlet tubes 12 may be connected to a single conventional TLE with one inlet nozzle. The inlet of the TLE may be an elliptically shaped chamber. As illustrated in FIG. 3A, all six outlet tubes 12 may be connected to an elliptical chamber 20. FIG. 3B illustrates the elliptical chamber 20 along cross-section Y-Y. Compared to a trifold fitting and Y-fitting, the direct connection as illustrated in FIGS. 3A and 3B may have low adiabatic volume. This may reduce the residence time and increases the olefin selectivity. The elliptical chamber is internally contoured for enhanced flow distribution to the TLE tubes and to minimize residence time. By eliminating all tri-fitting and Y fittings, the cost of heater may be reduced compared to conventional conical inlet.

Referring again to FIG. 1A, there are many arrangements for these six rows of 4-1 type coils. Such arrangements are shown in FIGS. 4-12 and described further below. The concept may be extended to more than 3 rows. With four rows, two rows will be on one side of the center line and two rows will be on the other side of the center line. Instead of a trifold fitting, a tetrafold fitting can be used to bring the outlet tubes 12 to the TLE. In some embodiments, two Y-fittings connected to another Yfitting, commonly known as tri-Y, may also be used. In such arrangements, a 4-1 type coil with 8 such rows connecting to one TLE is equivalent to a 32-8 coil type. With five rows of 4-1 type, for example, it would be equivalent to a 40-10 type feeding to one TLE. For all these cases, a conventional TLE with a single inlet may be used which requires multiple tri/tertra/penta fold fittings connecting to a Y-fitting connected to a single TLE inlet.

Figure 2:
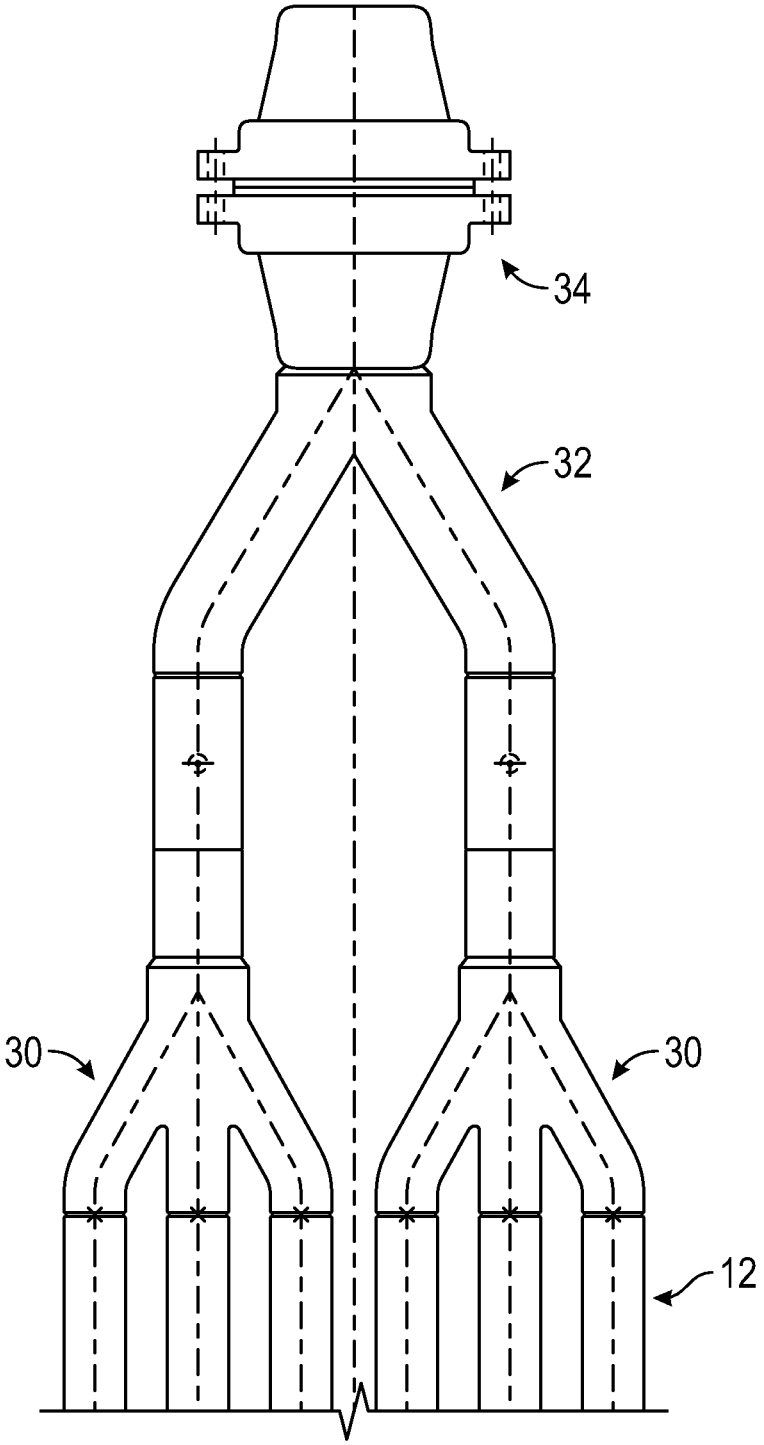
FIG. 2 illustrates a radiant coil arrangement useful in pyrolysis heaters according to one or more embodiments disclosed herein.

As illustrated in FIG. 2, two tri-fittings 30 are connected to a Y-fitting 32. Three outlet tubes 12 on the left side are connected to a tri-fitting 30 and then to one leg of the Y-fitting 32. The other three outlet tubes 12 are connected to a second tri-fitting 30 and then to the other leg of the Y-fitting 32. The outlet of the Y-fitting may be connected to a conventional TLE with a conical inlet 34.

In some embodiments, however, all the outlet coils 12 may be directly connected to the elliptical chamber on the TLE, which does not require any tri/tetra/penta-fold fittings and Y-fittings, as illustrated in FIGS. 3A and 3B. When there are many outlet tubes (>4), a linear exchanger with either two 4-1 coils or a single 4-1 coil can be connected to a double pipe exchanger (also called a linear exchanger).

While illustrated and described for FIG. 1 with respect to a 4-1 type coil as the basic unit, embodiments herein are applicable for other types of coils, including 1-1 type, 2-1 type, 3-1 type, 5-1 type and others up to a 16-1 type coil, for example. Embodiments herein are also applicable for other split coils. For example, a coil may have 4-2-1-1 arrangement (i.e., 4 inlet tubes connected to 2 tubes which are connected to one tube and then with a U bend to outlet tube). Six such 4-2-1-1 coils may be arranged similar to what was discussed above with respect to FIG. 1 for a 4-1 type coil. With 4-2-1-1 type coils, more than three rows may also be considered. As an additional example, an 8 pass coil has 8 tubes connected by U bends to form a serpentine coil. In some embodiments, the diameter can be constant for the entire length of the serpentine coil, and for other embodiments the diameter can vary from inlet to outlet across the serpentine coil.

Various arrangements of coils/rows are shown in FIGS. 4-12. They coils are shown as a two-pass coil. However, the coils may also be four pass, eight pass, and other types of coils having any number of passes.

Referring again to FIG. 1, only half of six coils of 4-1 type are shown. This will have 24-6 arrangement meaning 24 inlet tubes and 6 outlet tubes with half of the inlet tubes and half of the outlet tubes being arranged on each side, as illustrated in FIG. 1A. The 4-1 coil may be arranged in three rows A, B, C. Four inlet tubes 10 are connected to a single submanifold (such as manifold 4 as illustrated in FIG. 14) and then connected to an outlet tube 12. The radiant coil length can be, for example, 10 ft/pass to 50 ft/pass, or, from inlet to outlet, 20 ft to 100 ft for a two pass coil. For multi-pass coils, total length may be as much as 400 ft, for example, with 20 ft to 100 ft per two passes.

All the inlet tubes 10 of a row may be connected to a single bottom manifold, and may be adjacent to each other in the same row. All the manifolds may be placed in a trough, and the movements may be guided by channels in the trough. Burners may be placed in the floor, or on both sides of the coil, or in both the floor and sides of the coil. The burners may be arranged symmetrically (as shown) or asymmetrically (not shown).

In some embodiments, such coils may be connected to a conventional conical inlet shell and tube exchanger. In other embodiments, the coils may be connected to an elliptical shaped inlet for a TLE after a tri-fitting without a Y-fitting. In yet other embodiments, all six inlets can be connected directly with the elliptical inlet without any tri-fitting and Y-fittings. In yet other embodiments, the outlet coils may be connected to linear exchanger or double pipe exchanger. In embodiments where double pipe or linear exchangers are used, the outlets may be combined either through a collector system or through a series of tri/tertra/penta-fittings (for 3 rows, 4 rows and 5 rows, respectively) and then to one or more Y-fittings. From the transfer line exchanger, such a combined outlet may be further cooled in a second exchanger of any type for generating steam, including super high pressure steam. In some embodiments, instead of steam other process fluids can be heated.

All these options are not shown explicitly in figures, but implied. Any options described with respect to an embodiment are also contemplated for all other types of arrangements according to embodiments herein. Flow to each radiant coil inlet may be distributed via critical flow venturis, for example. The process fluid may be pre-heated in the convection section above the radiant section of the heater and one coil, or more than one coil may be fed to a crossover manifold before being distributed via the venturis. All common features of radiant coils will not be discussed here for brevity.

Figure 4:
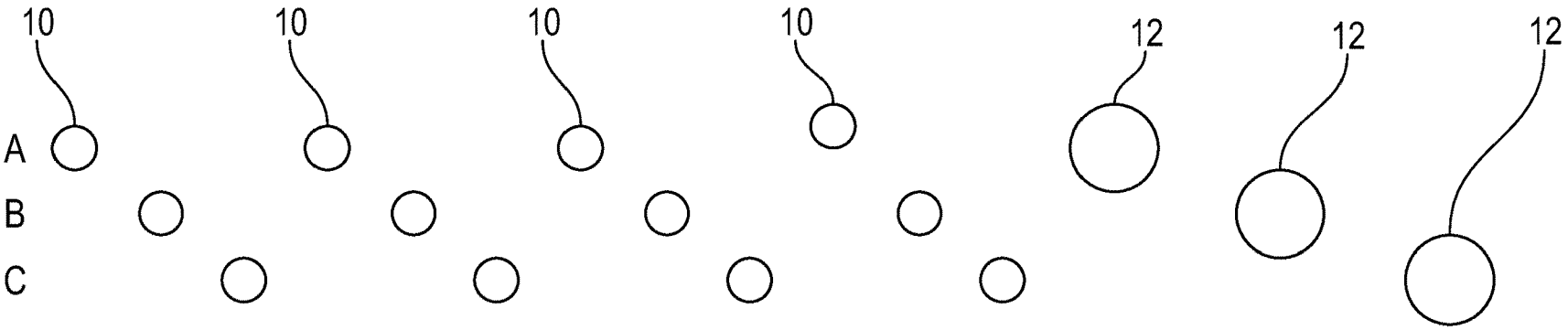
FIG. 4 illustrates a radiant coil arrangement useful in pyrolysis heaters according to one or more embodiments disclosed herein.

Referring now to FIG. 4, another embodiment for arranging coils according to embodiments herein is illustrated. This arrangement may have a similar bottom manifold connecting all first pass inlet tubes to outlet tubes as the manifold described previously.

In the arrangement as illustrated in FIG. 4, all inlet tubes (in this embodiment that is four per group) are spaced apart. The tube spacing to outside diameter (TS/OD) is the ratio of tube space for the same row to the diameter of the tube. This ratio may be in the range from 1.2 to 4.0. Such as between 1.4 to 2.0. In this arrangement TS/OD may be higher than that shown in FIG. 1. When all inlet tubes are taken together ($1^{st}$, $2^{nd}$ or $3^{rd}$ row), TS/OD can be low, and may be less than 1. For values of the TS/OD ratio greater than 1, no tube blocks another tube upstream or downstream. When TS/OD is low, peak to average flux ratio is high and hence the maximum temperature of the tube metal is high. To minimize this effect, TS/OD based on ratio may be maintained at a minimum level to reduce the overall floor area of the coils without blocking downstream tubes. However, with a lower TS/OD, more tubes can be packed in a given space, reducing the heater cost. A TS/OD ration of 1.4 to 1.8 may permit more tubes in a given floor area than that shown in FIG. 1. For tube repair and maintenance reasons, a minimum clearance may be required between two adjacent tubes. By alternating inlet tubes across the manifold to different rows, the tubes can be tightly packed in a single row without increasing the TS/OD ratio.

Figure 5:
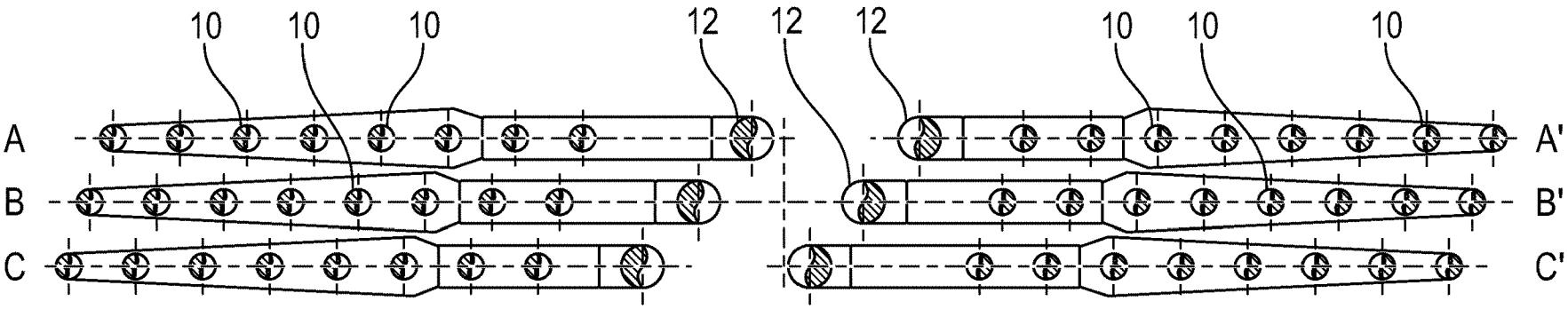
FIG. 5 illustrates a radiant coil arrangement useful in pyrolysis heaters according to one or more embodiments disclosed herein.

FIG. 5 illustrates another coil arrangement. As illustrated, an 8-1 coil arrangement has a total of 48 inlet tubes 10 and 6 outlet tubes 12. Inlet tubes 10 may be arranged in three rows A, B, C, (8 inlet tubes 10 in each row) and placed on one side and the other inlet tubes 10 may be arranged in three rows A', B', C' on the other side. Six outlet tubes 10 may be in the center with the rows A, B, C and A', B', C' on either side. This arrangement corresponds to 4-1 or 8-1. Similar patterns may be followed for other arrangements.

Figure 6:
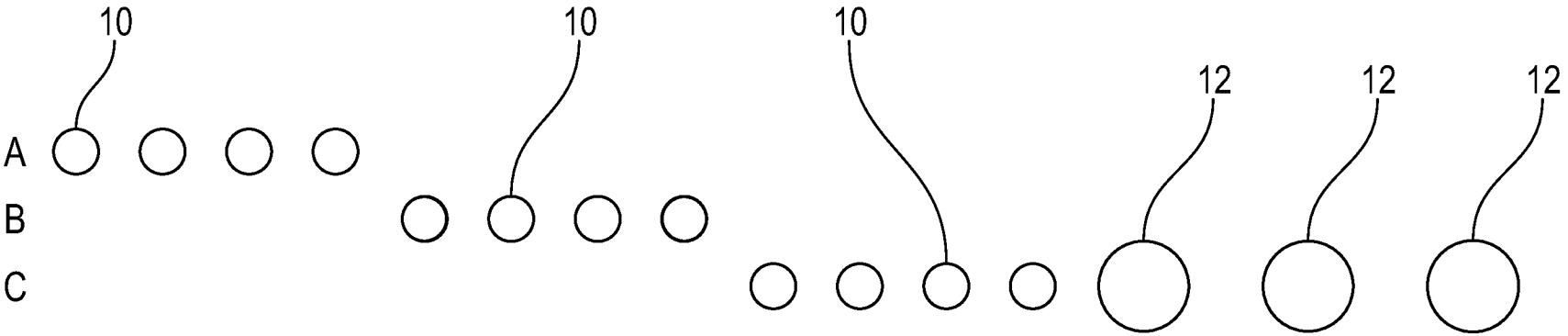
FIG. 6 illustrates a radiant coil arrangement useful in pyrolysis heaters according to one or more embodiments disclosed herein.

FIG. 6 illustrates another arrangement of the tubes, exemplified for a 4-1 coil. The arrangement as illustrated in FIG. 6 may have the outlet tubes 12 inline while the inlet tubes 10 are staggered. In this way, only the inlet tubes are arranged in three rows A, B, C. All outlet tubes may be at the centerline of the firebox, or in line with one of the rows A, B, C, (in line with C as illustrated). In this manner, the maximum temperature of the tube metal of the outlet tubes 12 may be consistent and may also be reduced as compared to other arrangements. As maximum metal temperature of the outlet tubes 12 may affect coking, keeping the outlet tubes inline may improve heater run length for multi-row embodiments as disclosed herein.

Figure 7:
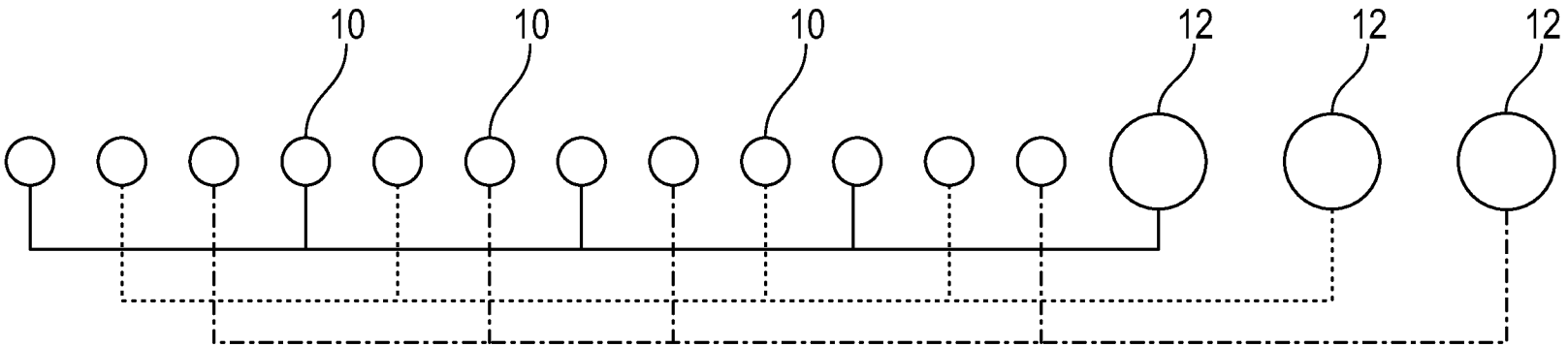
FIG. 7 illustrates a radiant coil arrangement useful in pyrolysis heaters according to one or more embodiments disclosed herein.

FIG. 7 illustrates an inline arrangement of three 4-1 coils. In this manner, all tubes (inlet tubes 10 and outlet tubes 12) are in a single row at the centerline of the firebox. The bottom manifold connecting the inlet and outlet tubes are placed in 3 rows. As discussed above, adjacent tubes can go to same manifold or a different manifold. When adjacent tubes feed different manifolds, a tighter spacing is possible. As illustrated in FIG. 7, every third inlet tube 10 may be connected to a different manifold. Each manifold may be connected to a different outlet tube 12. In this embodiment, the manifolds may be placed at relatively similar heights and places on one side of the center line, the center line, and the other side of the center line, respectively.

Figure 8:
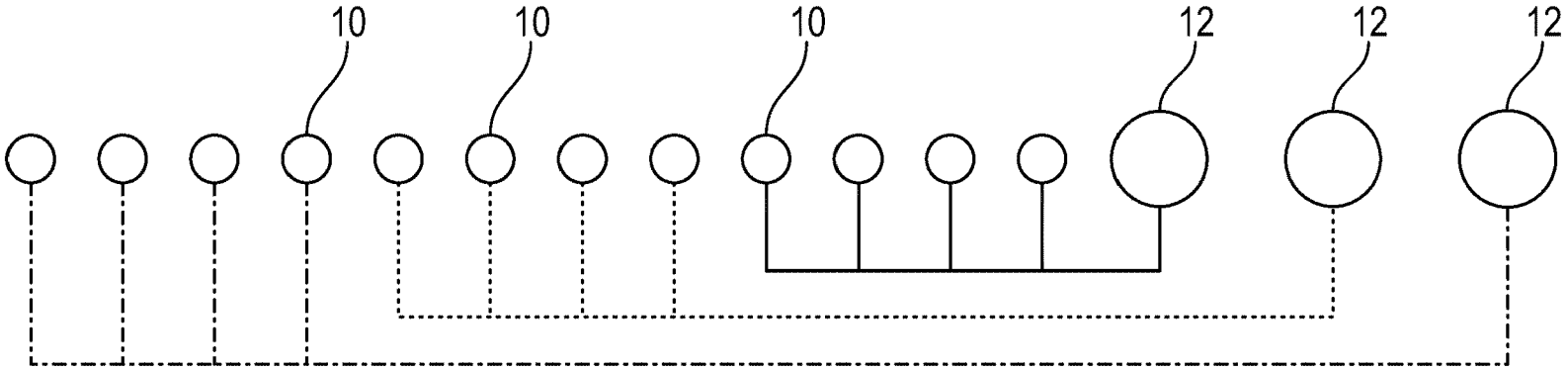
FIG. 8 illustrates a radiant coil arrangement useful in pyrolysis heaters according to one or more embodiments disclosed herein.

The embodiment of FIG. 8 is similar to that of the embodiment of FIG. 7, except the manifolds are also placed at the centerline of the radiant box. For this arrangement, the manifolds have to be stacked one above the other. That means all adjacent inlet tubes 10 (4 for the embodiment illustrated) will go to the same manifold. The manifold for each group of 4 tubes will have slightly different length so that one manifold can be placed above the next. Thermal expansion may be accounted for while determining the position (length) of each inlet tube 10 and outlet tube 12. As all tubes are in-line, the peak to average flux may be the low and hence maximum metal temperature may be low. A lower tube metal temperature may allow for long run length, permit more capacity, or both. However, with such an in-line arrangement, more tubes cannot be packed within the heater like other cases described herein.

For the embodiment as illustrated in FIG. 8, all inlet tubes 10 and outlet tubes 12 may be arranged vertically along the center line. The inner four tubes may be slightly shorter than the middle four tubes and the outer four tubes may be slightly longer than the middle four tubes. The manifolds connecting the inner and outer tubes may be stacked one above the other.

FIG. 1A, as discussed above, provides a symmetrical arrangement of coils. This symmetry can be applied to other configurations shown in FIGS. 4-8. In FIG. 1A, for example, the A row, B row and C row tubes are arranged in parallel. This results in outlet tubes 12 shifted by one diameter length respectively for the outlet tubes for rows A, B, and C. The outlet tubes 12 for rows A', B', and C' in the other half are symmetrical (mirror image). For the outlet tubes 12 as illustrated in FIG. 3B, only pseudo symmetry is used, allowing a closer spacing of the outlet tubes. However, for the outlet tube 12 arrangement as illustrated in FIG. 3B, when the distance between the rows is W, the distance between adjacent the inner outlet tubes is 2*W while for other adjacent outlet tubes the spacing between adjacent tubes is only W. Therefore, the shadow effect for the inner outlet tubes 12 will be more than that of other tubes.

Figure 9:
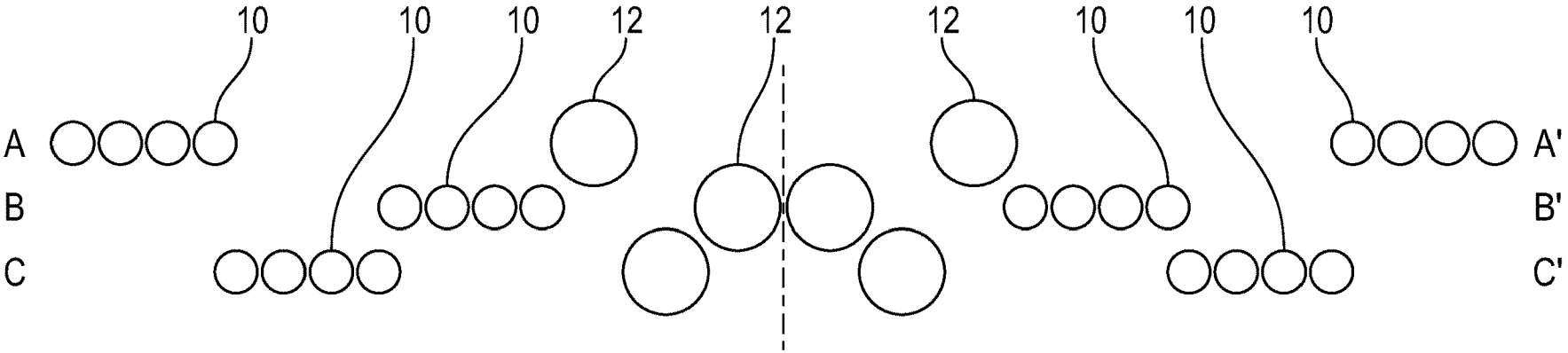
FIG. 9 illustrates a radiant coil arrangement useful in pyrolysis heaters according to one or more embodiments disclosed herein.

The shadow effect can be minimized using, for example, the mirror image arrangement shown in FIG. 9. As illustrated for FIG. 9, the inlet tubes 10 and outlet tubes 12 for rows B and B' may be located closer to the center line, while the inlet tubes 10 and outlet tubes 12 for rows A and A' may be placed father away from the center line, resulting in a 1, 3, 2 arrangement that gives a maximum distance between two adjacent outlet tubes as only W, and not 2W. In some embodiments, the distance between two adjacent outlet tubes may be 1.5W or even 1.1W. This may reduce the shadow effect and may improve the process performance. This arrangement may also be applied to embodiments having more than three rows.

Figure 11:
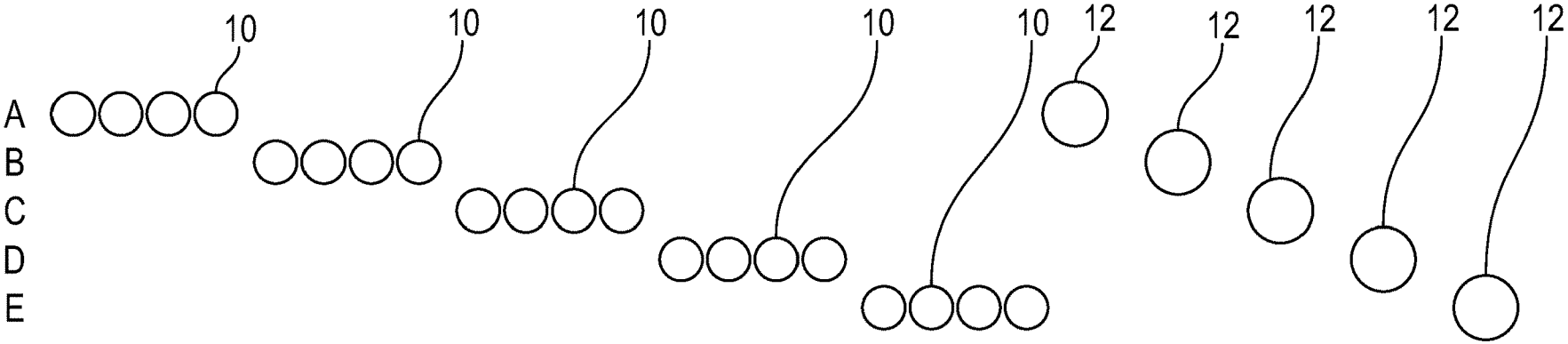
FIG. 11 illustrates a radiant coil arrangement useful in pyrolysis heaters according to one or more embodiments disclosed herein.

FIG. 10 illustrates an embodiment having four rows of tubes A, B, C, D. Any of the arrangements discussed for three rows may also apply to the arrangement with four rows. The radiant section centerline may be, for example, between row B and row C. Similar to other embodiments, only one-half of the total tubes are shown, the other one-half being disposed in a symmetrical or a pseudo-symmetrical arrangement, similar to FIGS. 1A, 5, and FIG. 11 illustrates an embodiment having five rows of tubes. Any arrangement discussed above with respect to three rows may also apply to the arrangement with five rows. Accordingly, FIGS. 10 and 11 illustrate how three rows can be extended to four or five rows. For this embodiment, the radiant box centerline may be along row C, for example.

Figure 12:
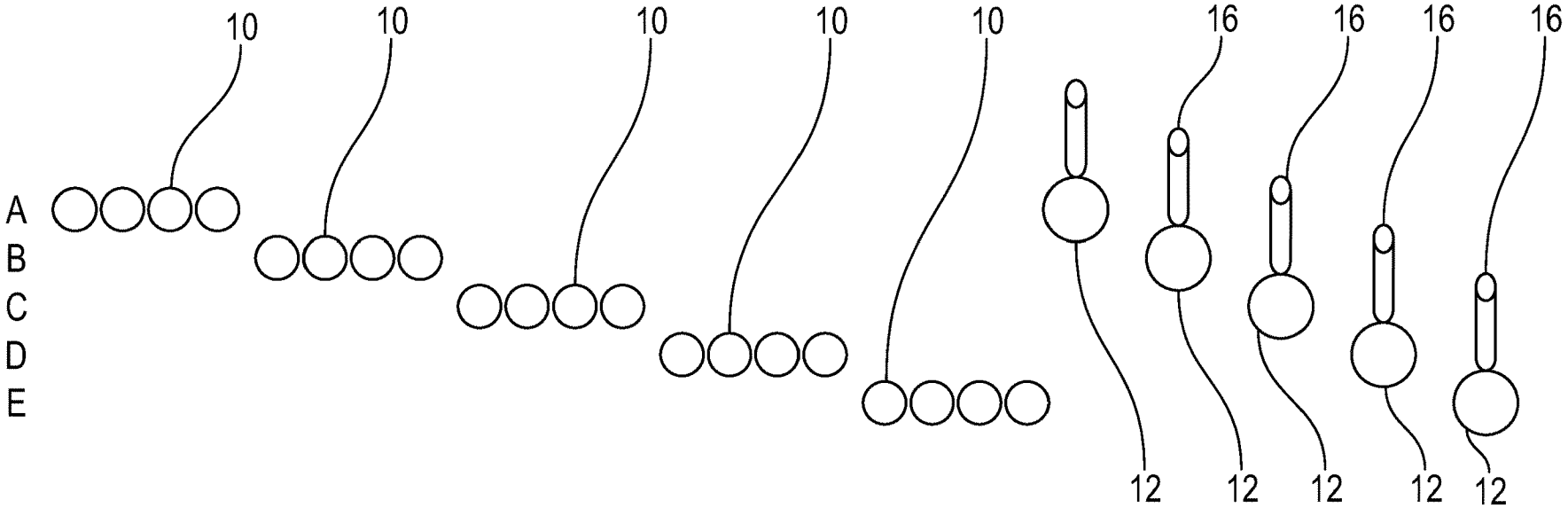
FIG. 12 illustrates a radiant coil arrangement useful in pyrolysis heaters according to one or more embodiments disclosed herein.

FIG. 12 illustrates an embodiment similar to FIG. 11 with five rows A, B, C, D, E. The outlet tubes 12 may be connected to individual linear exchangers 16 as an example. With a linear exchanger, there is no tri-fitting and Y-fitting. This may have a low adiabatic residence time, but the heat transfer rate of cooling may be lower for a linear exchanger and require a longer TLE. After the linear exchanger, a secondary exchanger, such as a shell and tube exchanger, may be used to further cool the fluid. Instead of generating steam, other process fluids can be used to transfer heat. In other embodiments, a third exchanger may be dedicated to process fluid heating while the first two exchangers generate steam by cooling the effluents from the outlet tubes 12. Other types of exchangers may also be used. As with other embodiments, only one-half of the tubes are shown.

In one or more embodiments herein, the coils may move freely for thermal expansion. The coils may be guided by the pins or rounded studs attached to the manifold which travel along a channel having the coils. This may reduce damage to the coils caused by contact during thermal expansion.

Figure 13A:
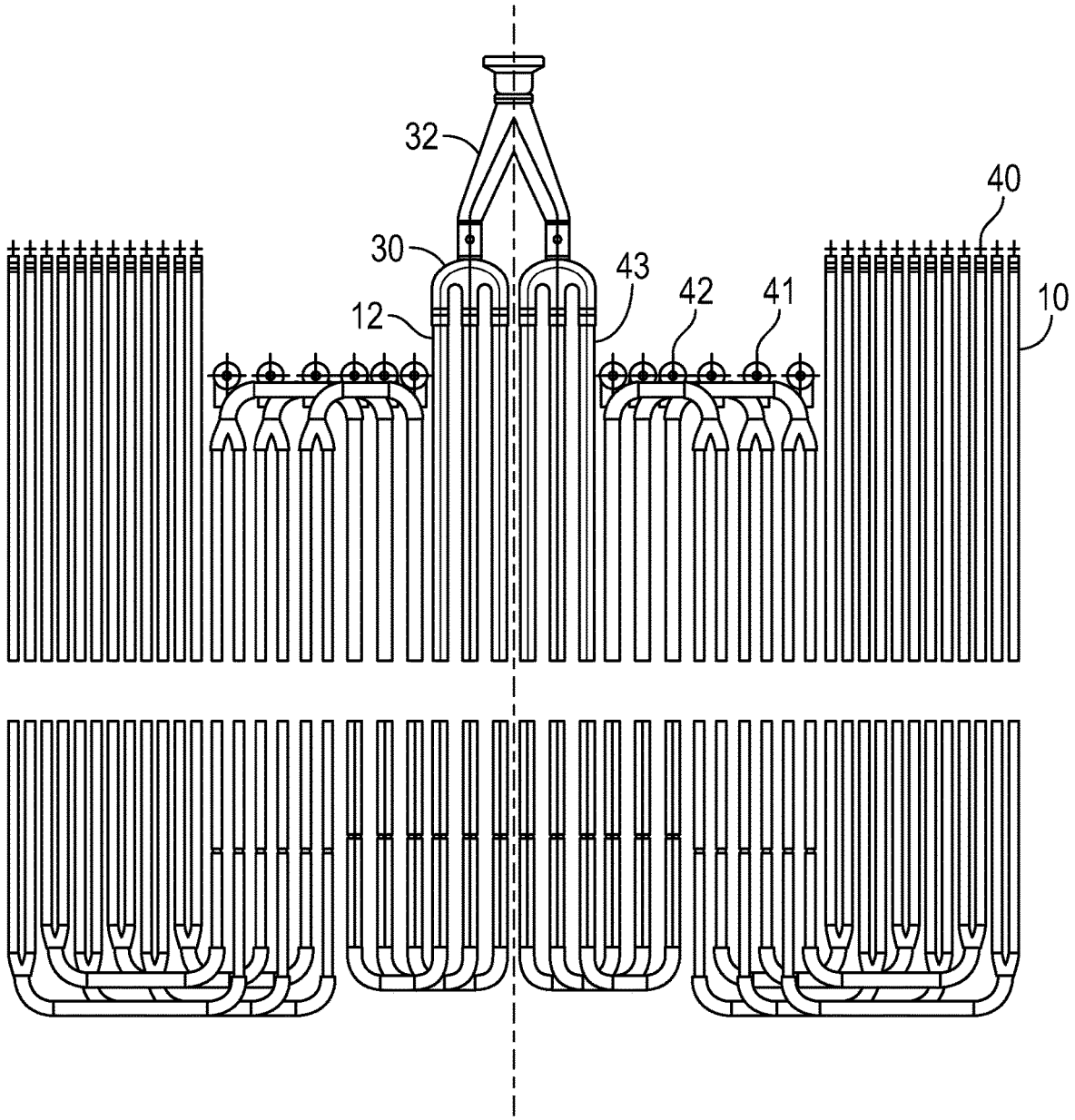
FIGS. 13A and 13B illustrates a radiant coil arrangement useful in pyrolysis heaters according to one or more embodiments disclosed herein.
Figure 13B:
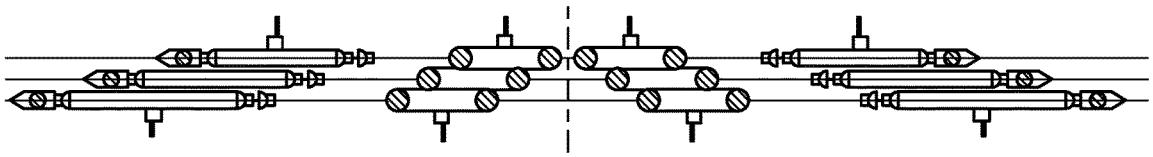

FIGS. 13A and 13B show a 4-2-1-1 type coil with three rows. FIG. 13B illustrates a top down view of the coil arrangement of FIG. 13A. This is a 4 pass coil (passes 40, 41, 42, 43) with 4 inlet tubes 10 connected to the outlet tubes 12 via a Y-fitting 32 which are connected to a tri-fitting 30 and then by a U bend to each row of tubes. The three outlet tubes 12 on each side of the heater are joined by a separate tri-fitting 30 and then to one leg of the Y-fitting 32.

As illustrated in FIGS. 13A and 13B with a four-pass system, the multi-row arrangements according to embodiments herein may be extended to coils having multiple passes (4, 6, 8, 10, 12, etc.) and are not limited to two pass coils. A wide variety of multiple pass coils may be arranged in configurations having more than two rows according to embodiments herein.

EXAMPLES

Example 1: The concept has been applied for a naphtha cracking heater design. The performance is illustrated through an example. A full range naphtha feed is cracked in any of the three row designs illustrated in the figures and described above. The performance is compared with a prior art two row design. The same subgroup (10-1 coil type) is used in both the three row arrangement and the two row arrangement. Only the arrangement (how the coils are arranged) is different between the two designs. In other words, both of the 2 and 3 row configurations are based on identical 2-pass coils of 10-1 type The feed properties are provided in Table 1, and the heater design and results are provided in Table 2.

TABLE 1

| Naphtha Feed Properties | |
|---|---|
| Specific Gravity (S.G.) | 0.718 |
| Initial Boiling Point (° F.) | 60 |
| 50 volume % Boiling Point (° F.) | 130 |
| End Boiling Point (° F.) | 172 |
| Paraffins, wt % | 94.9 |
| Naphthenes, wt % | 4.5 |
| Aromatics, wt % | 0.6 |

TABLE 2

| | Feed | |
|---|---|---|
| | Naphtha | Naphtha |
| | Design | |
| | 3 Row Design | 2 Row Design |
| Heater Feed Rate, T/h | 71.952 | 71.952 |
| Total 10-1 groups per heater | 48 | 48 |
| Number of radiant Coils/heater | 8 | 12 |
| Number of TLEs/heater | 8 | 12 |
| Flow Rate per coil, T/h/coil | 8.994 | 5.996 |
| Steam To Oil ratio, w/w | 0.5 | 0.5 |
| Cross over Temperature, F. | 1175 | 1175 |
| Coil outlet Temperature, F. | 1600 | 1600 |
| Severity, P/E, w/w | 0.45 | 0.45 |
| Ethylene Yield, wt % | 34.0 | 34.0 |
| Ethylene Production, T/hr/coil | 3.058 | 2.039 |
| Ethylene Production, T/hr/heater | 24.464 | 24.464 |
| Run length, days | 60 | 60 |

Example 2: This example is for ethane cracking. Ethane purity is 98.5% and is cracked in 4-2-1-1 type coils. Six such coils are arranged in 3 rows. A total of 12 such coils are arranged in 3 rows or two rows. The heater design and results are provided in Table 3.

TABLE 3

| | Feed | |
|---|---|---|
| | Ethane | Ethane |
| | Design | |
| | 3 Row Design | 2 Row Design |
| Heater Feed Rate, T/h | 47.0 | 47.0 |
| Total SRT3 coils per heater | 12 | 12 |
| Number of radiant Coils/heater | 2 | 3 |
| Number of TLEs/heater | 2 | 3 |
| Flow Rate per coil, T/h/coil | 23.50 | 15.67 |
| Steam To Oil ratio, w/w | 0.3 | 0.3 |
| Cross over Temperature, F. | 1265 | 1265 |
| Coil outlet Temperature, F. | 1525 | 1525 |
| Ethane Conversion, % | 65 | 65 |
| Ethylene Yield, wt % | 48.3 | 48.3 |
| Ethylene Production, T/hr/coil | 11.35 | 7.57 |
| Ethylene Production, T/hr/heater | 22.70 | 22.70 |
| Run length, days | 60 | 60 |

The above examples show that the same performance can be obtained with an increase flow rate by packing more coils per TLE.

These arrangements can be used to crack any hydrocarbon feed (ethane, propane, C3 LPG, C4 LPG, naphtha, gas oil, hydrocracked vacuum gasoil, crude oils, field condensates, raffiinates, where such feeds may be introduced individually or mixed) to produce olefins. The coil outlet pressure may be within the range from 15 psi to 95 psi and typically between 22 psi to 35 psi. The feeds can be mixed with dilution steam or may be processed without dilution steam. The coil outlet temperature may be within the range from 700 to 1000° C., such as from 780 to 880° C. Steam can be generated at any pressure level from 50 psi to 2000 psi, such as 1600-1800 psi.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed as new and desired to be protected by Letters Patent of the United States is:

1. A system for cracking hydrocarbons, comprising:

a fired heater having a radiant section and a convective section;

one or more radiant coils disposed within the radiant section of the heater, each of the one or more radiant coils comprising three to seven rows of multi-pass tubes, and wherein each of the three to seven rows of multi-pass tubes is collectively disposed symmetrically or pseudo symmetrically within the radiant section of the heater;

a single transfer line exchanger fluidly connected to an outlet tube of each of the three to seven rows of multi-pass tubes for each respective radiant coil of the one or more radiant coils.

2. The system of claim 1, wherein, for each respective radiant coil of the one or more radiant coils, the three to seven rows of multi-pass tubes each comprise inlet tubes fluidly connected to a respective one or more outlet tubes, each row of tubes having from 3 to 16 inlet tubes, and wherein at least three of the inlet tubes are fluidly connected to each respective outlet tube.

3. A system for cracking hydrocarbons, comprising:

a fired heater having a radiant section and a convective section;

a radiant coil, disposed within the radiant section of the heater, comprising three to seven rows of multi-pass tubes, wherein each row comprises two multi-pass tubes, and wherein the multi-pass tubes of the three to seven rows of multi-pass tubes are collectively disposed symmetrically or pseudo symmetrically within the radiant section of the heater;

a single transfer line exchanger fluidly connected to an outlet tube of each of the three to seven rows of multi-pass tubes.

4. The system of claim 3, wherein the three to seven rows of multi-pass tubes each comprise inlet tubes fluidly connected to a respective one or more outlet tubes, each row of tubes having from 3 to 16 inlet tubes, and wherein at least three of the inlet tubes are fluidly connected to each respective outlet tube.

5. The system of claim 3, wherein the three to seven rows of multi-pass tubes are two-pass tubes, four-pass tubes, six-pass tubes, or 8-pass tubes.

6. The system of claim 3, wherein a tube spacing between each adjacent row of inlet tubes is a length W, and wherein a tube spacing of each adjacent outlet tube is no greater than 2W.

7. The system of claim 3, wherein a tube spacing between each adjacent row of inlet tubes is a length W, and wherein a tube spacing of each adjacent outlet tube is no greater than 1.5W.

8. The system of claim 3, wherein a tube spacing between each adjacent row of inlet tubes is a length W, and wherein a tube spacing of each adjacent outlet tube is no greater than 1.1W.

9. The system of claim 3, further comprising a heating coil disposed in the convective section of the heater, the heating coil being fluidly connected to a feed distributor configured for distributing a flow of hydrocarbons to each of the inlet tubes of the radiant coil.

10. The system of claim 3, wherein a manifold fluidly connects a first set of inlet tubes to an outlet tube, and wherein an outlet tube is provided for every 3 to 14 inlet tubes.

11. The system of claim 10, wherein the inlet tubes and the outlet tubes of each row are respectively arranged linearly.

12. The system of claim 10, wherein the inlet tubes of the three to seven rows of multi-pass tubes are arranged non-linear with respect to the outlet tubes.

13. The system of claim 12, wherein the outlet tubes are arranged linearly with respect to a middle of the three to seven rows of multi-pass tubes.

14. The system of claim 1, wherein, for each respective radiant coil of the one or more radiant coils, the three to seven rows of multi-pass tubes each comprise inlet tubes fluidly connected to a respective one or more outlet tubes, each row of tubes having from 3 to 16 inlet tubes;

wherein, for each respective radiant coil of the one or more radiant coils, a first row of the three to seven rows of multi-pass tubes is disposed linearly along a line, and wherein a second row of the three to seven rows of multi-pass tubes is disposed linearly on a first side of the line, and a third row of the three to seven rows of multi-pass tubes is disposed linearly on another side of the line.

15. The system of claim 1, wherein the radiant coil comprising three to seven rows of multi-pass tubes comprises three to seven rows of inlet tubes.

* * * * *